US005534749A

United States Patent [19]

Ohoshi et al.

[11] Patent Number: 5,534,749

[45] Date of Patent: Jul. 9, 1996

[54] FIELD-EMISSION DISPLAY WITH BLACK INSULATING LAYER BETWEEN TRANSPARENT ELECTRODE AND CONDUCTIVE LAYER

[75] Inventors: Toshio Ohoshi, Tokyo; Tadashi Kiyomiya, Saitama; Masami Okita, Kanagawa, all of Japan

[73] Assignee: Sony Corporation, Tokyo, Japan

[21] Appl. No.: 277,576

[22] Filed: Jul. 20, 1994

[30] Foreign Application Priority Data

Jul. 21, 1993 [JP] Japan ..... 5-180332

[51] Int. Cl.[6] ..... H01J 1/62

[52] U.S. Cl. ..... 313/497; 313/309; 313/336; 315/169.3

[58] Field of Search ..... 313/495, 496, 313/497, 309, 336, 351; 315/169.3, 169.4

[56] References Cited

U.S. PATENT DOCUMENTS

| | | | |
|---|---|---|---|
| 4,472,658 | 9/1984 | Morimoto et al. | 313/497 |
| 4,908,539 | 3/1990 | Meyer | 315/169.3 |
| 5,347,292 | 9/1994 | Ge et al. | 313/309 |

FOREIGN PATENT DOCUMENTS

| | | |
|---|---|---|
| 0404022A3 | 12/1990 | European Pat. Off. . |
| 0527240A1 | 2/1993 | European Pat. Off. . |
| 59-169282 | 9/1984 | Japan . |

OTHER PUBLICATIONS

"Phosphors for Full–Color Microtips Fluorescent Displays", by F. Levy et al., IEEE 1991, pp. 20–23. Conference Record of the 1991 International Display Research Conference, 15 Oct., 1991, San Diego, Calif.

*Primary Examiner*—Sandra L. O'Shea
*Assistant Examiner*—Matthew J. Esserman
*Attorney, Agent, or Firm*—Hill, Steadman & Simpson

[57] ABSTRACT

A field-emission display has a phosphor panel assembly comprising a transparent electrode, a plurality of coated phosphor layers disposed on the transparent electrode for emitting light in response to bombardment of electron beams emitted from field-emission cathodes, a plurality of black insulating layers disposed between the coated phosphor layers, and a plurality of conductive layers disposed on the black insulating layers, respectively, between the coated phosphor layers and electrically insulated from the transparent electrode by the black insulating layer. The black insulating layers provide a black mask between the phosphor layers to improve the contrast ratio, and the conductive layers are effective to increase the percentage of electron beam utilization, thus improving the quality and resolution of displayed images. These advantages can be achieved without making image display unstable due to charging-up of the black mask and straying of secondary electrons.

3 Claims, 4 Drawing Sheets

FIELD-EMISSION DISPLAY WITH BLACK INSULATING LAYER BETWEEN TRANSPARENT ELECTRODE AND CONDUCTIVE LAYER

BACKGROUND OF THE INVENTION

The present invention relates to a field-emission display having low-speed electron beam phosphor layers for emitting light in response to bombardment of an electron beam applied from field-emission cathodes.

Electron-beam excited field-emission display devices include a vacuum fluorescent display (VFD) employing low-speed electron beam phosphor layers, so-called Aiken and Gerber tubes, a flat display in the form of a secondary electron multiplier, and a display with a matrix drive system.

Most of these displays are energized at a high voltage, and hence it is difficult to lower their power consumption.

The VFDs are low-voltage excited displays. Since the VFDs have not been advanced to a technical level for displaying television images, and have a relatively low resolution, there have been no reports on attempts to produce high-contrast VFDs for displaying high-quality, high-resolution NTSC and high-definition television images.

Research and development efforts have been made with respect to field-emission displays (FEDs) employing field-emission microcathodes which can be energized at a low voltage and have a relatively high resolution.

A flat field-emission display comprises an ultra-thin display panel having microtip cathodes in the form of very small conical cathodes fabricated according to a microfabrication process. Electrons are emitted from the microtip cathodes and are applied to excite a confronting phosphor panel to display signals. One such flat field-emission display is schematically illustrated in FIG. 1 of the accompanying drawings.

As shown in FIG. 1, the flat field-emission display has a cathode panel 1 made of glass or the like, and a plurality of cathode electrodes 2 made of Cr or the like which are patterned in stripes on the cathode panel 1. A plurality of gate electrodes 4 made of Mo, W, or the like are patterned as stripes perpendicular to the cathode electrodes 2 on insulating layers 3 which are deposited on the cathode electrodes 2. The cathode electrodes 2 and the gate electrodes 4 have areas of intersection which have a plurality of small holes 5 defined therein, each of the small holes 5 housing a cathode therein.

FIG. 2 of the accompanying drawings schematically shows a cathode arrangement of the flat field-emission display. After the cathode electrodes 2, the gate electrodes 4, and the insulating layers 3 have been successively deposited by sputtering, vacuum evaporation, or the like, holes 5 are defined by wet etching, for example. Thereafter, conical field-emission cathodes 6 made of W or the like are formed in the respective holes 5 by oblique evaporation, sputtering, or the like while the cathode panel 1 is being rotated.

For displaying color images, R (red), G (green), and B (blue) phosphor layers are formed in stripes on transparent electrodes 12 made of ITO (oxide of mixed In, Sn) which are mounted on an inner surface of a front panel 11 made of glass or the like. The panels 1, 11 are then hermetically sealed by a seal member with a spacer having a thickness of several hundreds μm interposed therebetween, thus keeping a certain level of vacuum between the panels 1, 11.

When an electric field having a field intensity ranging from $10^6$ to $10^8$ V/cm at a voltage ranging from 10 to 100 V is applied between the field-emission cathodes 6 and the gate electrodes 4, electrons are emitted from the tip ends of the cathodes 6. When the confronting transparent electrodes 12 are maintained at a potential of about 300 V, the emitted electrons are applied to the R, G, B phosphor layers, which then emit light to display a color image.

To increase the contrast of the flat field-emission display, a black carbon layer which is used as a black mask in an ordinary cathode-ray tube (CRT) may be included in the flat field-emission display. However, the black carbon layer will cause a short circuit between the R, G, B phosphor layers as the black carbon layer is electrically conductive.

When the insulating layer 3 is bombarded by emitted electrons, if the material of the insulating layer 3 has a high secondary electron emission ratio, then it is charged up to a positive potential, and if the material of the insulating layer 3 has a low secondary electron emission ratio, then it is charged up to a negative potential. Therefore, the emission from the R, G, B phosphor layers varies with time, resulting in an unstable image display. Secondary electrons tend to stray, thus disturbing the electric field.

Another problem is that if a commercially available ordinary black glass paste which is an insulation and is used for screen printing or the like is added for an increased contrast, then the display panel is not made sufficiently black.

SUMMARY OF THE INVENTION

It is an object of the present invention to provide a field-emission display which can display images at an improved contrast ratio without unstable image display and short circuits between phosphor layers for color display, and which can utilize a greater percentage of electron beams for displaying high-quality images at a high resolution.

According to the present invention, there is provided a field-emission display comprising a plurality of field-emission cathodes for emitting electron beams, and a phosphor panel assembly comprising a transparent electrode, a plurality of coated phosphor layers disposed on the transparent electrode for emitting light in response to bombardment of the electron beams emitted from the field-emission cathodes, a plurality of black insulating layers disposed between he coated phosphor layers, and a plurality of conductive layers disposed on the black insulating layers, respectively, between the coated phosphor layers and electrically insulated from the transparent electrode by the black insulating layer.

A voltage Vf lower than a potential Vp applied to the transparent electrode is applied to the conductive layers.

The coated phosphor layers comprise color coated phosphor layers, and the field-emission display further comprises color selecting means for switching between electron beams applied to the color coated phosphor layers. A voltage Vf applied to the conductive layers is modulated depending on the switching by the color selecting means between electron beams applied to the color coated phosphor layers.

Because the conductive layers are disposed on the black insulating layers between the coated phosphor layers, the field-emission display has a high contrast ratio, the black insulating layers are prevented from being charged up, and secondary electrons are prevented from straying.

When a voltage lower than the potential of the transparent electrode is applied to the conductive layers, the conductive layers serve as electrodes for converging electrons on the phosphor layers. Consequently, the percentage of utilized electrons is greatly increased.

If the coated phosphor layers are RGB coated phosphor layers, then when a voltage lower than the potential of selected phosphor layers, e.g., R (or G, B) phosphor layers' is applied to the conductive layers, the electron beams directed to the selected phosphor layers are converged efficiently, and the emission of light from the phosphor panel assembly is made uniform.

DETAILED DESCRIPTION OF THE PREFERRED EMBODIMENTS

Figure 1:
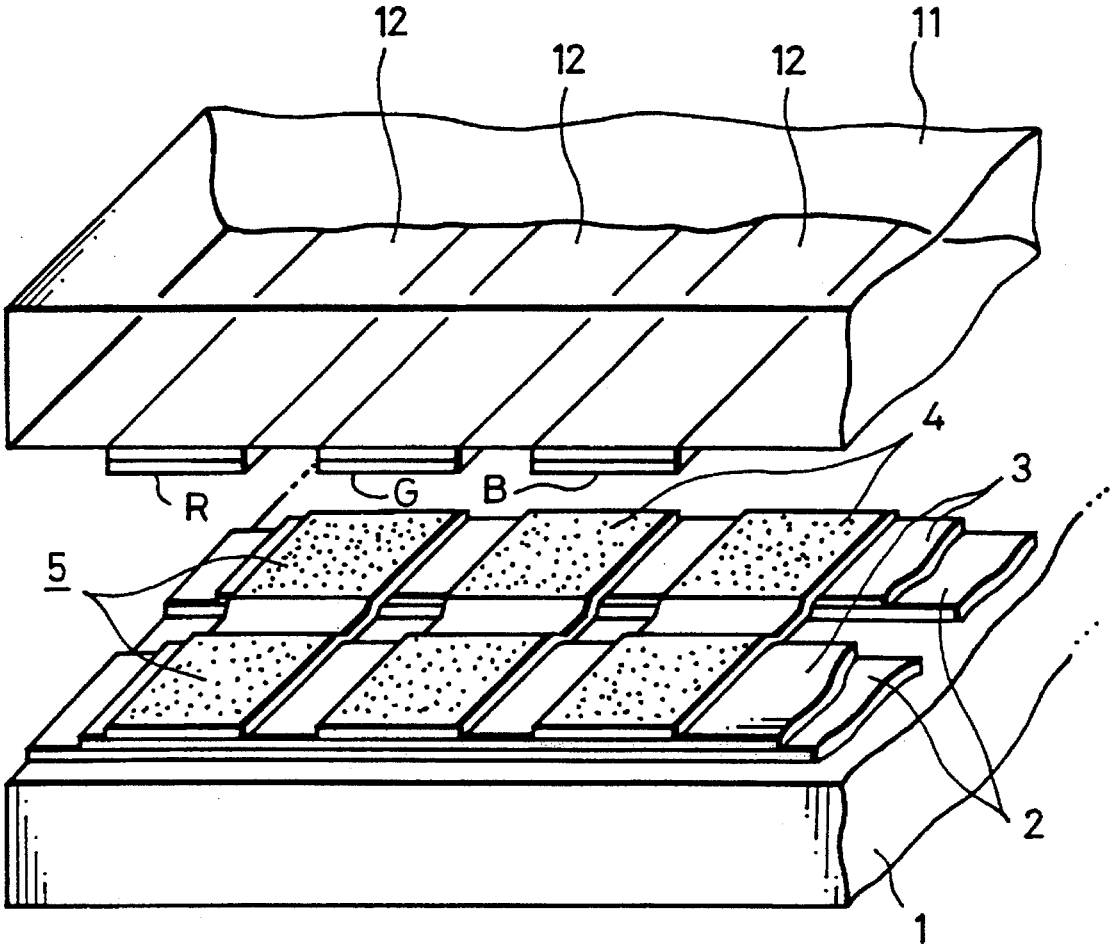
FIG. 1 (PRIOR ART)
FIG. 1 is a fragmentary perspective view of a flat field-emission display having field-emission cathodes.
Figure 2:
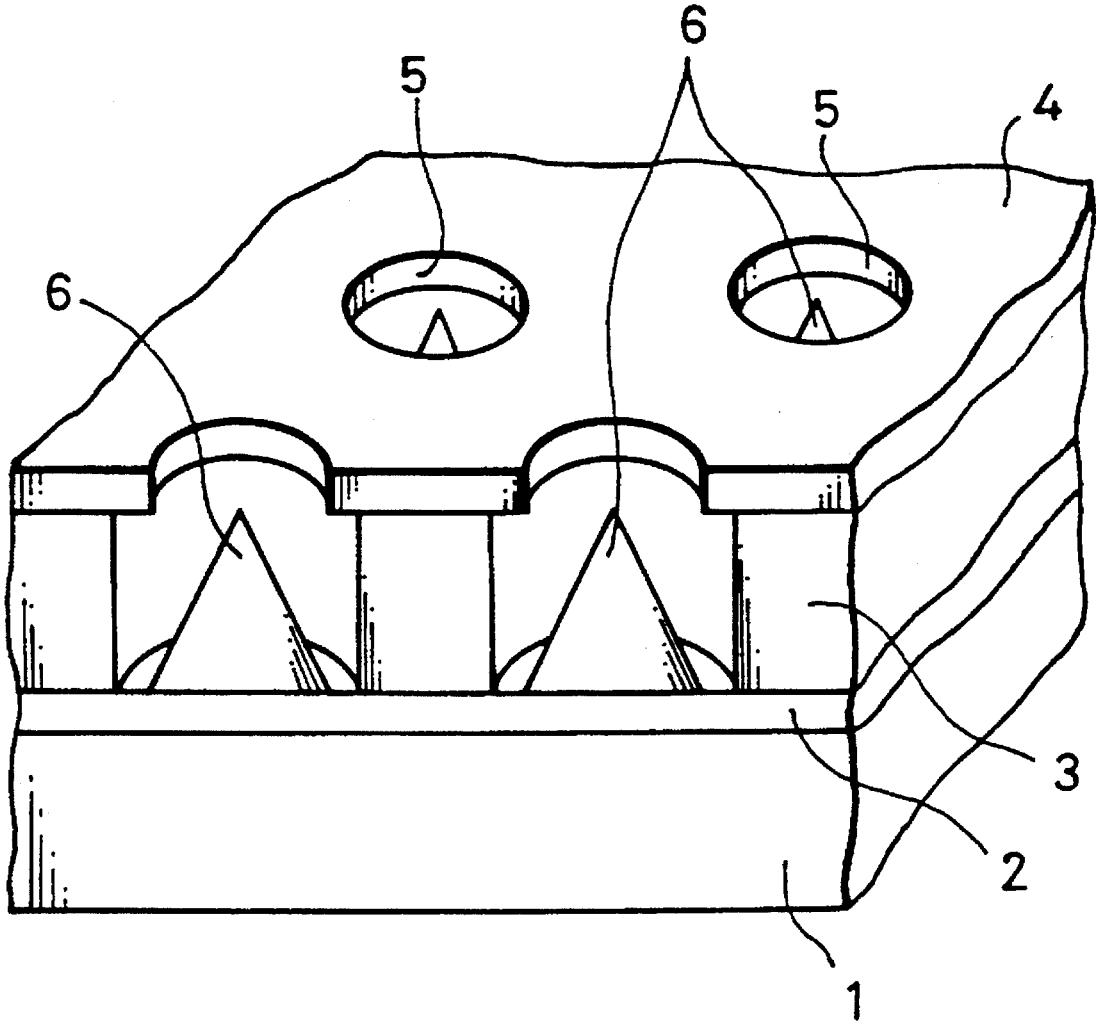
FIG. 2 (PRIOR ART)
FIG. 2 is an enlarged fragmentary perspective view of a cathode arrangement of the flat field-emission display shown in FIG. 1.
Figure 3:
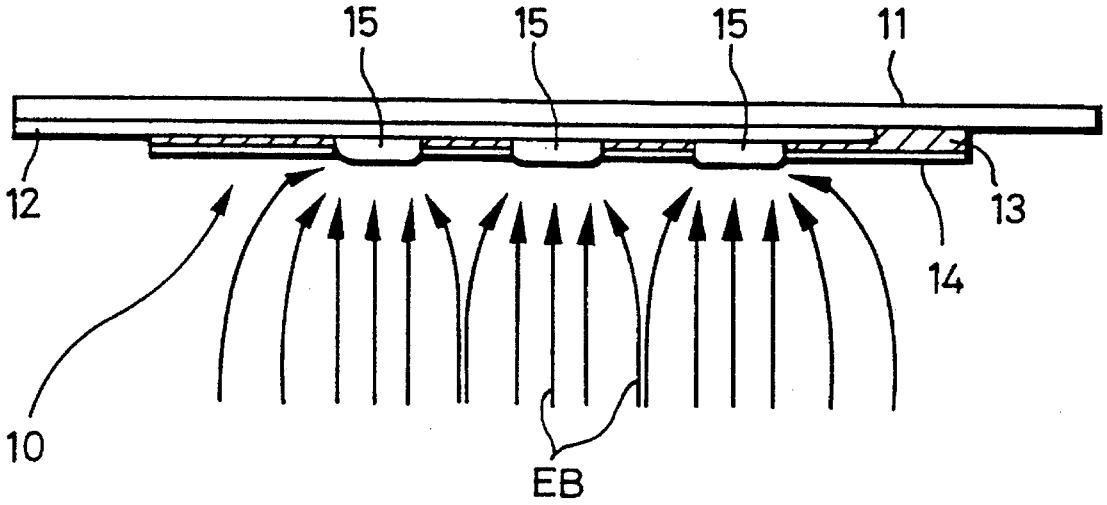
FIG. 3 is a fragmentary cross-sectional view of a field-emission display according to an embodiment of the present invention.
Figure 4:
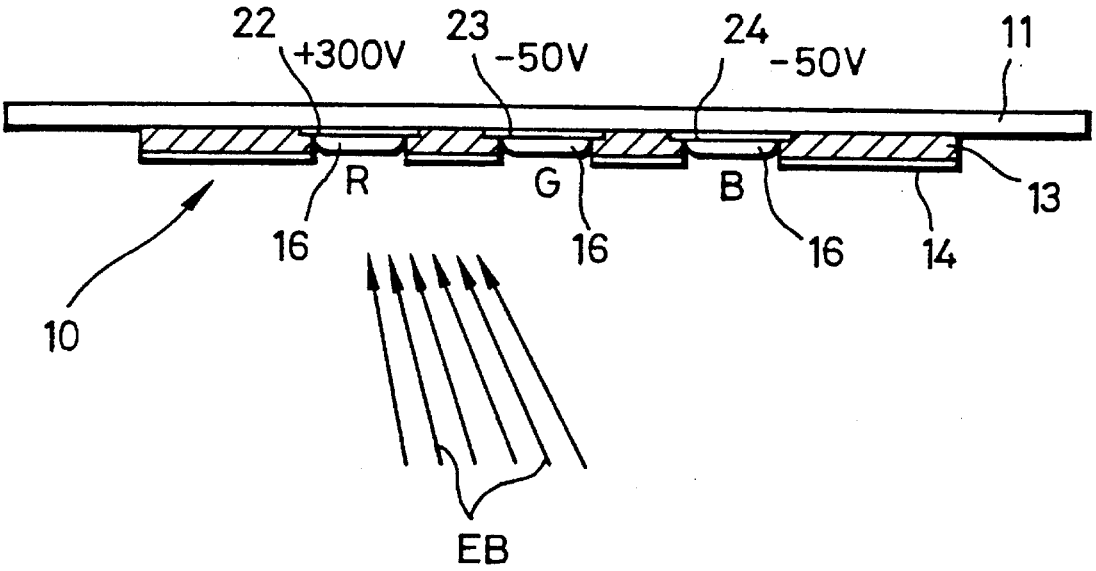
FIG. 4 is a fragmentary cross-sectional view of a field-emission display according to another embodiment of the present invention.

FIGS. 3 and 4 show field-emission displays according to different embodiments of the present invention. Each of the field-emission displays shown in FIGS. 3 and 4 employ a field-emission cathode arrangement as shown in FIGS. 1 and 2. When a strong electric field having a field intensity ranging from $10^6$ to $10^8$ V/cm is applied between the field-emission cathodes 6 and the gate electrodes 4, tunnel electrons. are emitted through a vacuum barrier into the vacuum, and accelerated and applied to a phosphor surface on the inner surface of a glass panel for thereby displaying an image.

FIG. 3 shows in cross section a phosphor surface of a flat field-emission display with field-emission cathodes. In FIG. 3, the flat field-emission display displays images monochromatically. A transparent electrode 12 made of ITO or the like is mounted on an inner surface of a front panel 11 made of glass or the like, the transparent electrode 12 being shared by coated phosphor layers. A black insulating layer 13 made of an insulating glass paste, which may be G3-0428 (trade name) manufactured by Okuno Pharmaceuticals K.K., for example, is patterned, as by printing, in the form of a mesh or stripes on the transparent electrode 12 by printing, the black insulating layer 13 having a thickness less than 50μm, for example. A conductive layer 14 made of a conductive paste, which may be G6-0082 (trade name) manufactured by Okuno Pharmaceuticals K.K., for example, is patterned, as by printing, on the black insulating layer 13 in the same pattern as the black insulating layer 13.

Thereafter, support columns are provided for keeping a vacuum between the cathode panel (not shown) and the front panel 11 Subsequently, phosphor layers 15 are coated on the transparent electrode 12 by electrodeposition, thereby producing a phosphor panel assembly.

The conductive layer 14 serving as an electrode for converging electrons is disposed immediately in front of the phosphor panel assembly. When a voltage of Vp=300 V, for example, is applied through the transparent electrode 12 to the coated phosphor layers 15 and a voltage lower than 300 V, e.g., a voltage Vc of −50 V, is applied to the conductive layer 14, electron beams are converged as indicated by EB in FIG. 3.

If only a black insulating paste were applied between the coated phosphor layers 15, it would be charged up by the applied electron beams, greatly affecting the influx of the electron beams to the phosphor layers 15.

According to the present invention, the black insulating layer 13 is provided and the conductive layer 14 is disposed thereon, as described above, for increasing a contrast ratio. By applying a suitable voltage to the conductive layer 14, as described above, it is possible to direct the electron beams efficiently toward the phosphor layers 15. Therefore, the percentage of utilized electron beams is improved.

The dielectric strength between the transparent electrode 12 and the conductive layer 14 is highly important to achieve the above effects instable fashion, and hence it is necessary to appropriately select the material and thickness of the insulating layer 13. For example, when the insulating layer 13 was made of $SiO_2$, for example, a dielectric strength of 2 kV or higher was obtained with the thickness of the insulating layer 13 being 50 μm.

FIG. 4 shows in cross section a phosphor surface of a flat field-emission display with field-emission cathodes. In FIG. 4, the flat field-emission display displays images in colors. In this embodiment, cathode arrays are not arranged in one-to-one correspondence to color phosphor layers, but one cathode group is provided for RGB phosphor layers. With such an arrangement, color images can be displayed when the RGB phosphor layers are selected and energized in a time-division multiplex fashion. Those parts shown in FIG. 4 which are identical to those shown in FIG. 3 are denoted by identical reference numerals, and will not be described in detail.

The field-emission display shown in FIG. 4 has a group of field-emission cathodes as shown in FIGS. 1 and 2 in confronting relation to a phosphor panel assembly. When an electric field having a field intensity ranging from $10^7$ to $10^8$ V/cm is applied between the gate electrodes and the cathode electrodes, electrons are emitted from the cathodes' are accelerated' and are applied to phosphor layers for thereby displaying an image.

As shown in FIG. 4, R, G, B phosphor layers 16 are coated in stripes on respective transparent electrodes 22, 23, 24, . . . (only three are shown) of ITO or the like which are disposed on an inner surface of a front panel 11. Insulating layers 13 and conductive layers 14 are patterned by printing or the like on the front panel 11 between the coated phosphor layers 16. The insulating layers 13 and the conductive layers 14 may be made of the same materials as those described above in the embodiment shown in FIG. 3. The R, G, B phosphor layers 16 are coated by electrodeposition or the like on the transparent electrodes 22, 23, 24, thus providing a phosphor panel assembly 10.

To select the R phosphor layers 16, the potential $V_{p1}$ of the transparent electrodes 22 associated with the R phosphor layers 16 is set to +300 V, for example, and the potentials $V_{p2}$ and $V_{p3}$ of the transparent electrodes 23, 24 associated with the G, B phosphor layers 16 are set to −50 V, for example. The electron beams EB emitted from the cathodes are now directed toward only the R phosphor layers 16.

When a voltage Vc equal to or higher than the voltage of −50 V applied to the unselected electrodes 23, 24 and lower than the voltage of 300 V applied to the R phosphor layers is applied to the conductive layers 14, the electron beams are caused to concentrate and converge efficiently on the R phosphor layers.

The insulating layers 13 are required to maintain a desired dielectric strength between the transparent electrodes 22~24 and the conductive layers 14, and to withstand high-speed switching between the potential of about 300 V applied to select phosphor layers and the potential of about 50 V not applied to select phosphor layers.

Since the black insulating layers 13 are included, the contrast ratio of the field-emission display is increased, and the percentage of electron utilization is improved while preventing the transparent electrodes from suffering a short circuit. The black insulating layers 13 are prevented from being charged up, and the secondary electrons are prevented from straying.

The field-emission display according to the present invention was analyzed for electron beam trajectories. It was confirmed that when the potential of the conductive layers 14 was modulated, the convergence of the electron beams, i.e., the landing characteristics of the electron beams, applied to the phosphor display assembly 10 was improved.

Figure 5:
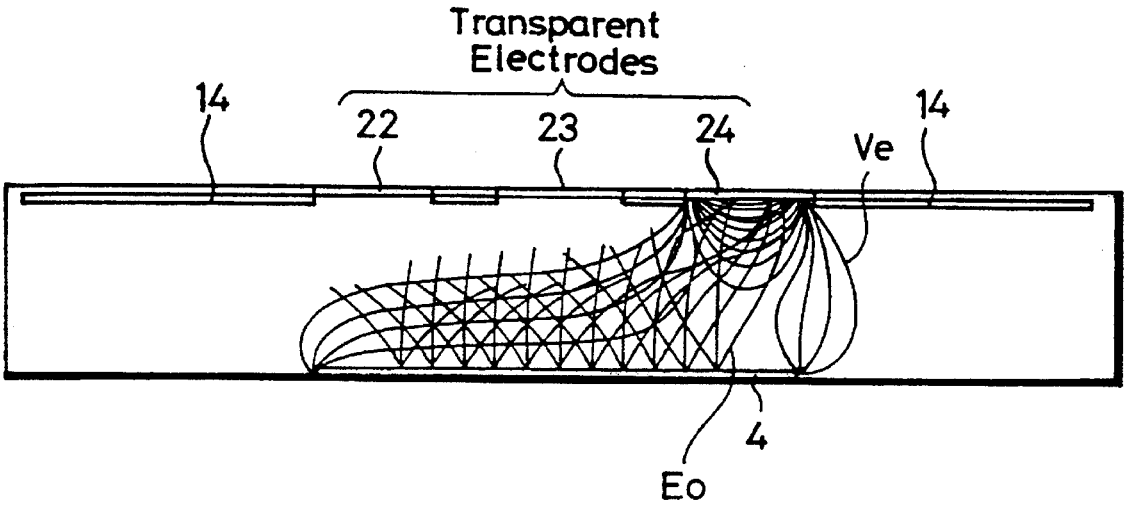
FIG. 5 is a cross-sectional view showing the results of an analysis of the field-emission display according to the present invention for calculated electron trajectories.

FIG. 5 shows the results of a general two-dimensional analysis of the field-emission display for electric field calculations and trajectory tracking according to the finite element method. In FIG. 5, the phosphor layers are omitted from illustration, and the conductive layers 14, the transparent electrodes 22~24 associated with the phosphor layers, and the gate electrodes 4 of the field-emission cathodes are schematically illustrated. Equipotential lines between these components are indicated by Ve, and electron trajectories by Eo. In this example, a voltage of +300 V was applied to the selected transparent electrode 24, a voltage of −50 V was applied to the unselected transparent electrodes 22, 23, and a voltage of −50 V or higher and not exceeding 300 V, e.g., a voltage of −50 V, was applied to conductive layers 14 as convergence electrodes.

Figure 6:
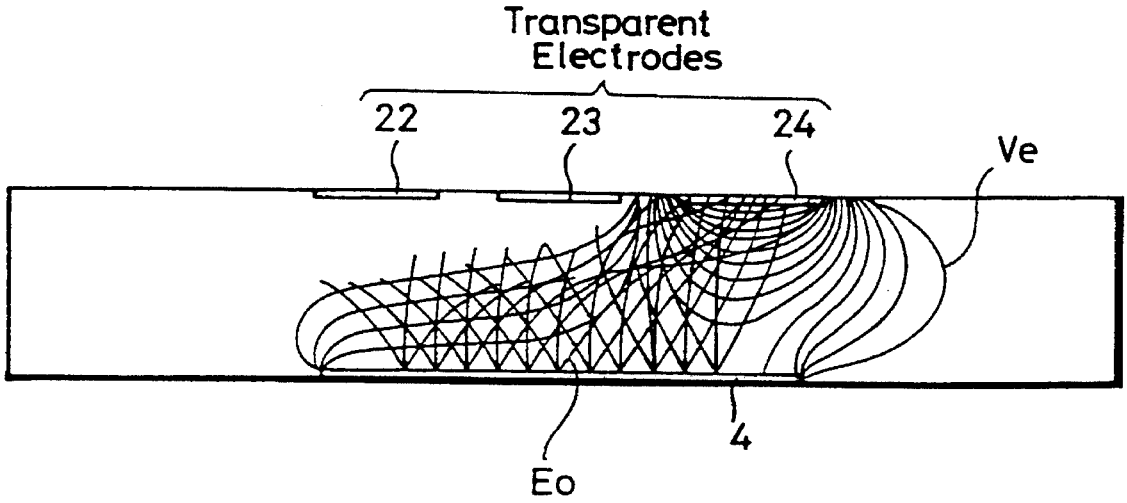
FIG. 6 (PRIOR ART)
FIG. 6 is a cross-sectional view showing the results of an analysis of a field-emission display according to a comparative example for calculated electron trajectories.

FIG. 6 shows the results of an analysis of a field-emission display according to a comparative example for calculated electron trajectories, the comparative field-emission display being devoid of any conductive layers 14 as convergence electrodes. Those parts shown in FIG. 6 which are identical to those shown in FIG. 5 are denoted by identical reference numerals, and will not be described in detail.

A comparison between the results shown in FIGS. 5 and 6 shows that in the example of the invention, electron beams concentrate and converge efficiently and uniformly on desired phosphor layers, and in the comparative example, electrons are applied in a wide region around selected phosphor layers, resulting in a much poorer electron utilization percentage. Even when a selected phosphor layer is positioned obliquely with respect to the cathode group as shown in FIGS. 5 and 6, electrons are applied uniformly to the entire surface of the selected phosphor layer.

With the present invention, the conductive layers 14 are employed as convergence electrodes independent of the transparent electrodes, and a suitable potential is applied to the conductive layers 14 for reducing waste electrons, i.e., an ineffective current, to selectively apply electrons to desired phosphor layers, and also to adjust the landing of the electrons. Accordingly, it is possible to improve the uniformity of emission from the phosphor panel assembly.

When the RGB phosphor layers are fabricated in finer dimensions for displaying high-quality images at a higher resolution, the present invention is effective to provide a relatively simple adjustment function to keep the displayed image quality optimum, thus allowing field-emission displays to be designed with much greater freedom.

The materials of the insulating layers 13 and the conductive layers 14, and the patterns of the phosphor layers and the cathodes may be changed or modified.

With the arrangement of the present invention, the insulating layers which provide a black mask increase a contrast ratio, and the conductive layers disposed on the insulating layers prevent the insulating layers from being charged up and also prevent secondary electrons from straying, thus allowing the field-emission display to display images in stable fashion.

Since the conductive layers are provided in insulated relation to the transparent electrodes on the phosphor layers, it is possible to avoid a short circuit between the phosphor layers when color images are displayed. When a voltage which is lower than the voltage applied to the phosphor layers is applied to the conductive layers as independent electrodes independent on the transparent electrodes, the percentage of utilized electrons that are applied to the phosphor layers is greatly increased. By varying the voltage applied to the conductive layers, it is possible to adjust the landing of the electron beams for thereby improving the emission uniformity of the phosphor panel assembly.

When the RGB phosphor layers are fabricated in finer dimensions for displaying high-quality images at a higher resolution, the principles of the present invention are effective to keep the displayed image quality optimum. The field-emission display according to the present invention is highly advantageous when employed as an NTSC or high-definition television display.

Having described preferred embodiments of the invention with reference to the accompanying drawings, it is to be understood that the invention is not limited to those precise embodiments, and that various changes and modifications could be effected by one skilled in the art without departing from the spirit or scope of the invention as defined in the appended claims.

What is claimed is:

1. A field-emission display, comprising:

a plurality of field-emission cathodes for emitting electron beams;

a phosphor panel assembly comprising a front panel, first, second and third different color phosphor layers coated on respective first, second, and third electrically independent transparent electrodes lying on an inner surface of said front panel, said phosphor layers emitting different color lights in response to bombardment of the electron beams emitted from the field-emission cathodes, a black insulating layer respectively disposed between the phosphor layers at the inside surface of the front panel, a conductive layer on the insulating layer between and adjacent each of the phosphor layers but not overlying the phosphor layers, and said black insulating layer insulating said conductive layer from said phosphor layers and said respective transparent electrodes;

a voltage $V_f$ applied to said conductive layer; and a voltage $V_{P1}$ applied to said first transparent electrode, a voltage $V_{P2}$ applied to said second transparent electrode, and a voltage $V_{P3}$ applied to said third transparent electrode, and when said first phosphor layer emits light with the second and third phosphor layers not emitting light, said voltage $V_{P1}$ is greater than $V_{P2}$ and $V_{P3}$ and said voltage $V_f$ is lower than $V_{P1}$.

2. A field-emission display according to claim 1 wherein $V_{P2}=V_{P3}$.

3. A field-emission display according to claim 1 wherein $V_f=V_{P2}=V_{P3}$.

* * * * *